US008091157B2

(12) United States Patent
Tyler et al.

(10) Patent No.: US 8,091,157 B2
(45) Date of Patent: Jan. 10, 2012

(54) MODULAR PORTABLE RESTROOM

(75) Inventors: Daniel G. Tyler, Crown Point, IN (US); Jamie P. Kostelyk, Hammond, IN (US); Jacob H. Shubinski, Berwyn, IL (US); Vaughan D. Smith, II, Chicago, IL (US); Rodney M. Mullett, Hammond, IN (US)

(73) Assignee: PolyJohn Enterprises Corporation, Whiting, IN (US)

( * ) Notice: Subject to any disclaimer, the term of this patent is extended or adjusted under 35 U.S.C. 154(b) by 282 days.

(21) Appl. No.: 12/393,026

(22) Filed: Feb. 25, 2009

(65) Prior Publication Data

US 2010/0212082 A1 Aug. 26, 2010

(51) Int. Cl.
*A47K 11/04* (2006.01)

(52) U.S. Cl. ..... 4/477; 4/479; 52/79.1; 52/282.2; 52/282.3

(58) Field of Classification Search ..... 4/449, 476–478; 52/36.1, 36.2, 79.1, 280, 281, 282.1, 282.2, 52/282.3

See application file for complete search history.

(56) References Cited

U.S. PATENT DOCUMENTS 3,730,605 A * 5/1973 Eckard ..... 312/265.5
3,783,920 A * 1/1974 Weikert ..... 383/66
4,744,111 A * 5/1988 Tegg et al. ..... 4/460
5,168,586 A * 12/1992 Small ..... 4/597
5,682,622 A * 11/1997 Tagg ..... 4/449
6,059,488 A * 5/2000 Green ..... 404/12
6,418,672 B1 * 7/2002 Hampel ..... 52/79.1
6,427,256 B1 * 8/2002 Mullett et al. ..... 4/476
6,507,958 B1 * 1/2003 Tagg ..... 4/321
6,766,541 B2 * 7/2004 Adams et al. ..... 4/449
6,932,225 B2 * 8/2005 Rowe ..... 211/90.02
2001/0037612 A1 * 11/2001 Militzer ..... 52/36.1
2006/0064910 A1 * 3/2006 Shankle ..... 40/594
2006/0260214 A1 * 11/2006 Tagg ..... 52/79.1
2007/0163036 A1 * 7/2007 Holmstadt ..... 4/449
2008/0307575 A1 * 12/2008 Heilman ..... 4/476

* cited by examiner

*Primary Examiner* — Brian Glessner
*Assistant Examiner* — Brian D Mattei
(74) *Attorney, Agent, or Firm* — Harness, Dickey & Pierce, P.L.C.

(57) ABSTRACT

A modular portable cabana-type restroom includes a roof, base platform, foot portions, side wall panels, a back wall panel, four corner portions and a door. The side wall panels and back wall panel are provided with vertically-disposed hooks for interlocking with complementary slots along the edges of the corner portions. The roof is provided with clips for engaging the corner portions. This permits convenient interlocking removable assembly of the wall panels, corner portions and roof without the use of mechanical fasteners, such as rivets, screws or nuts and bolts. Recesses in the foot portions accept the insertion of the corner portions and corners of the base portion, which are then secured together through formed apertures using a minimum number of mechanical fasteners. This provides for easy assembly and disassembly of the restroom for transport, repair and storage.

12 Claims, 4 Drawing Sheets

MODULAR PORTABLE RESTROOM

FIELD

The present disclosure relates to portable stand-alone restrooms having modular design and assembly.

BACKGROUND

This section provides background information related to the present disclosure which is not necessarily prior art.

This invention relates to the construction of a portable stand-alone cabana-type restroom of the type used for temporary restroom facilities that has an easily-assembled modular structure requiring minimum use of mechanical fasteners to achieve and maintain an assembled condition.

Portable stand-alone cabana-type restrooms housing restroom facilities such as toilets and sinks provide people with restroom facilities at concerts, parks, fairs, sporting events, construction sites and other places of public gathering where such facilities would otherwise be unavailable. Conventional cabana-type restrooms typically include walls constructed from relatively large, thin sheets or panels of thermoplastic material such as polyethylene-type plastic. The walls may be flat or may include indentations, ribs or other similar type features as desired and define both the height and the width of the cabana enclosure. One wall panel typically includes a door frame with a door hingedly connected thereto for providing access to the interior of the restroom. A base or floor component is also typically provided, to which the walls are attached, and a roof is typically attached to the upper portions of the walls.

Many portable restrooms are designed to form a generally square enclosure. Accordingly, the assembly of such restrooms requires the attachment of multiple (typically four) side wall panels together upon a base and the subsequent attachment of a roof. The attachment of side wall panels to each other can be done either directly or through the use of intermediate connector panels, brackets or other devices of various types. However, such attachment typically requires the use of numerous mechanical fasteners, such as rivets, screws or nuts and bolts, which has at least four disadvantages: (1) additional number of parts required to complete the restroom assembly (which increases overall cost); (2) additional time and effort required to complete an assembled condition of the restroom; (3) additional time and effort required to partially disassemble the restroom or remove one or more individual components, such as for repair; and (4) additional time and effort required to completely disassemble the restroom, such as for saving space during transportation, making complete disassembly often impractical.

Portable restrooms are often transported at various times during their distribution and use, such as from the manufacturer to the purchaser (such as a restroom provider and maintenance company), among various locations where they are used, to and from storage facilities and to and from repair and maintenance facilities. When portable restrooms are transported in an assembled condition, they require significantly more space than if they were transported in a disassembled condition. However, the use of numerous mechanical fasteners provides limitations on when and where the restroom units can be assembled and disassembled.

The use of numerous mechanical fasteners during the assembly of such restrooms tends to dictate where and when the restrooms must be assembled before being delivered to the purchaser. In the use of rivets, the assembly of the restroom is not practically performed at any location other than at the manufacturer's facility or distribution center because of the specialized equipment, specialized skill and/or substantial effort required to assemble the restrooms. In the use of screws or nuts and bolts, the equipment, skill and effort required to assemble the restrooms is somewhat less, but the assembly is nevertheless time and effort-consuming due to the large number of fasteners required to assemble a typical portable restroom. Therefore, regardless of whether numerous rivets or nuts and bolts are used, it is generally impractical to assemble the restrooms at any location other than at the manufacturer's facility or distribution center.

The use of numerous mechanical fasteners during the assembly of such restrooms also tends to dictate the cost, effort and location required for the repair of damaged restrooms. In some situations, one or more side panels, connector assemblies, doors, roofs, bases or other major structural components of portable restrooms become damaged, due to weather, vandalism or use. Many times, it is desirable to repair the restroom by replacing only the damaged component(s). Where the restroom is assembled using many rivets to attach the components, the rivets associated with the damaged component(s) must be removed, such as by drilling them out, and the replacement component(s) must be riveted in its/their place. Since such repair can generally only be accomplished at a repair facility, any damaged restrooms must typically be transported to such a repair facility and re-transported to their storage or next use location. Where the restroom is assembled using many screws or nuts and bolts to attach the components, the screws or nuts and bolts associated with the damaged component(s) must be removed, and the replacement component(s) must be rescrewed or rebolted in its/their place. While it is possible to repair this type of restroom at its location of use or at a storage facility, the required time and effort for removing the numerous mechanical fasteners would often make such repairs impractical, causing such damaged units to also be transported back to a dedicated repair facility. Therefore, regardless of whether numerous rivets, screws or nuts and bolts are used, it is generally impractical for a restroom owner or restroom fleet owner to repair typical damaged restrooms at any location other than at the owner's storage facility or dedicated repair center. Accordingly, such repairs may even require the assistance of the manufacturer, which would involve even more transportation, effort and cost.

The use of numerous mechanical fasteners during the assembly of such restrooms also tends to make the assembly semi-permanent, in that the restrooms cannot practically be disassembled without substantial effort and cost. Disassembly or partial disassembly of portable restrooms could be desirable for restroom owners in a number of instances. Sometimes, restricted space for transportation (and/or associated cost for additional space) might make the convenient disassembly of portable restrooms beneficial. In addition, in many parts of the world, such restrooms are only used during warm-weather seasons and are stored during cold-weather seasons. Restricted storage space (and/or associated cost for additional space), might also make the convenient disassembly of portable restrooms beneficial.

Ease of assembly and disassembly is also desirable with respect to other restroom components for the same reasons. The base and roof are also often assembled using rivets, screws and/or nuts and bolts, which require similar significant effort during both assembly and disassembly operations. For the same reasons as those set forth above, it is also desirable to minimize the number of fasteners required for attaching these components and to make the assembly and disassembly as convenient as possible.

SUMMARY

This section provides a general summary of the disclosure, and is not a comprehensive disclosure of its full scope or all of its features.

The invention contemplates a modular portable cabana-type restroom that requires a minimum amount of mechanical fasteners for achieving an assembled condition of the restroom. The restroom includes a base platform of a generally square flat configuration and having four corners, and a foot portion removably attached to each corner of the base platform. Each foot portion includes a recess disposed therewithin. The restroom further includes a pair of side wall panels, each including a plurality of hooks disposed along its vertical side edges, and a back wall panel including a plurality of hooks disposed along its vertical side edges. A pair of rear, vertically-disposed, corner portions each includes a plurality of slots disposed along its side edges, so that each rear corner portion may be attached to the pair of side wall panels and the back wall panel without the use of separate mechanical fasteners through the engagement of the hooks and slots. A pair of front, vertically-disposed, corner portions each includes a plurality of slots disposed along one side edge for attachment to the side wall panels without the use of separate mechanical fasteners through the engagement of the hooks and slots.

The restroom also includes a door having a hinge edge and a locking edge, with the door hingedly attached along its hinge edge to one side edge of one front corner panel. The door is operable for being opened for accessing an interior portion of the restroom and closed at its locking edge against a side edge of the opposing front corner panel for maintaining a closed condition of the restroom. The restroom also includes a roof having a plurality of removable clips attached for removably securing the roof relative to the corner portions in an assembled condition without the use of separate mechanical fasteners. The foot portions are arranged so that the said corner portions, the wall panels and the base platform can each be inserted within the recesses of the foot portions. A minimum number of removable mechanical fasteners are then disposed through the foot portions, the base platform, the corner portions and the wall panels for securing these components together for maintaining an assembled condition of the restroom. Preferably, the roof also contains a recessed header for engaging an upper surface of the door when in its closed position.

The door of the restroom is also preferably attached without the use of mechanical fasteners. To accomplish this, the vertical side edge of one front corner panel includes notches operable for engaging corresponding complementary notches disposed along the hinge edge of the door in an interlocking manner. The engagement between the complementary notches permits the insertion of a vertically-disposed hinge tube between the door and the front corner panel for hingedly attaching said door to said front corner panel without the use of mechanical fasteners.

The base platform may include an upper surface that is tilted toward an edge of the base platform to promote the draining of fluids away from the restroom door, and toward the rear of the restroom where a waste storage tank is located. The waste storage tank may have a lower surface that is tilted in a manner complementary to the upper surface of the base platform for enhancing a retained condition of the waste storage tank at a location adjacent to a rear edge of the base platform. The waste storage tank may also include a plurality of locking tabs operable for engaging diagonally-opposed corner portions of the restroom for enhancing a retained condition of the waste storage tank at a location adjacent to a rear edge of the base platform.

At least one of the wall panels may be substantially smooth in its surface configuration for facilitating cleaning. In addition, at least one of the wall panels may include space suitable for containing advertising material. The foot portions may also extend outwardly from each corner of the base portion for facilitating the attachment of straps around the restroom for transporting the restroom. The corner portions each may also include handles molded into the corner portions for facilitating transportation of the restroom. In addition, the roof may include recesses molded into the roof for facilitating the attachment of straps around the restroom for transporting the restroom.

An object of this invention is to provide a modular portable restroom having interlocking components that can be assembled using a minimum of mechanical fasteners, thereby enhancing flexibility regarding choice of the location for assembly of the restroom.

A further object of this invention is to provide a modular portable restroom having interlocking components that can be easily disassembled (either in whole or in part) for the convenient replacement of damaged components without having to be transported to a dedicated repair facility.

Still a further object of this invention is to provide a modular portable restroom having interlocking components that can be easily disassembled (either in whole or in part) for convenient transportation or storage of the restroom.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
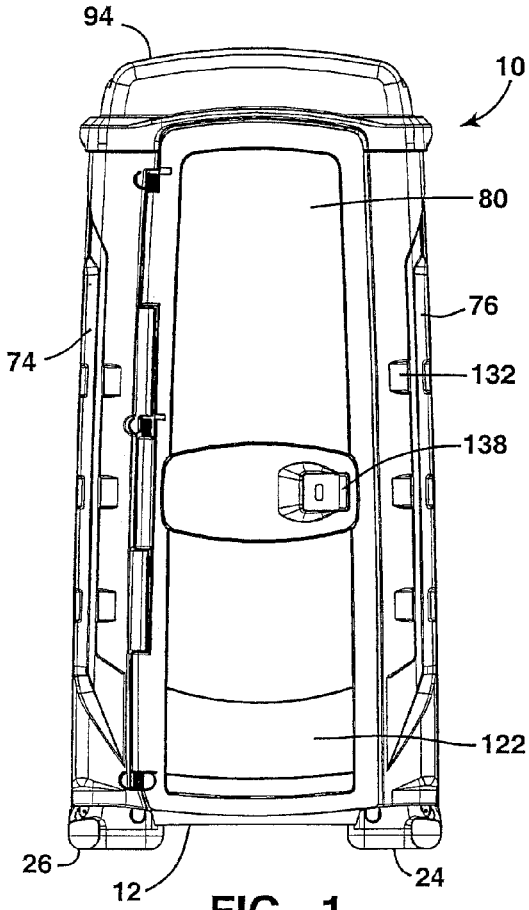
FIG. 1 is a front, elevational view of the modular portable restroom.

Example embodiments will now be described more fully with reference to the accompanying drawings.

Referring to the drawings, a modular portable cabana-type restroom is shown generally at 10. The restroom 10 is constructed to include a base platform 12, rotationally molded from a suitable plastic material such as polyethylene into a generally square flat configuration. The base platform 12 accordingly has four corners 14, 16, 18 and 20, numbered clockwise from the right rear of the platform. A plurality of foot portions 22, 24, 26 and 28 are shown to be removably attached to the four corners 14, 16, 18 and 20 of the base platform 12. Each foot portion includes a recess 30, 32, 34 and 36 (see FIG. 5) formed therewithin. The restroom 10 also includes a pair of side wall panels 38 (right, viewed from the restroom front) and 40 (left, viewed from the restroom front), extruded in sheet form from a suitable plastic material, such as polyethylene.

Figure 5:
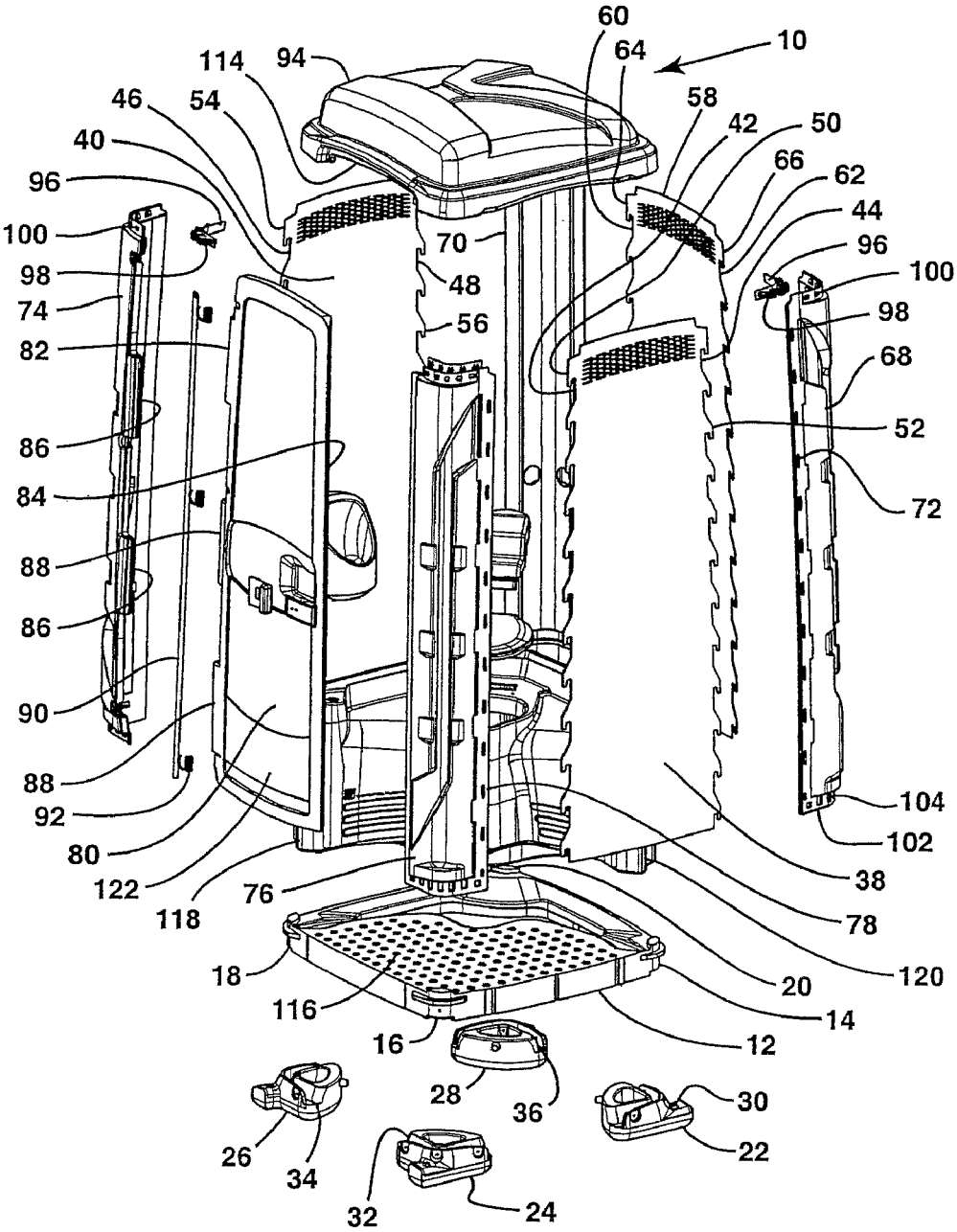
FIG. 5 is an exploded perspective, front and right, view thereof.
Figure 6:
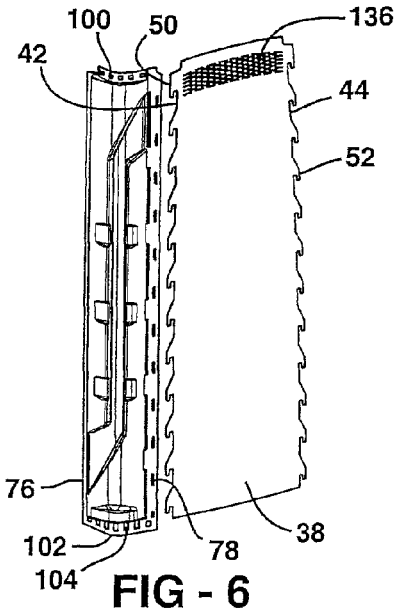
FIG. 6 is an exploded, perspective view showing the attachment of a side wall panel to a corner portion.

Each side wall panel 38 and 40 includes a pair of vertical side edges 42 and 44 (for side wall panel 38) and 46 and 48 (for side wall panel 40) (see FIG. 5). Each side panel includes a plurality of hooks 50, 52, 54 and 56 disposed along the vertical side edges of the side wall panels. In the arrangement shown herein, twelve such hooks are disposed along each edge of each side wall panel, although other suitable numbers could also be used. The hooks are shown to be vertically-arranged and downwardly-oriented, although other suitable configurations could also be used. The hooks are integrally formed into the edges of the side wall panels by suitable means such as machining.

The restroom 10 also includes a rear wall panel 58 (see FIG. 5), also extruded in sheet form from a suitable plastic material, such as polyethylene. In similar manner as the side wall panels 38 and 40, the rear wall panel 58 also includes a pair of vertical side edges 60 and 62 and a plurality of hooks 64 and 66 disposed along its vertical side edges. In the arrangement shown herein, twelve such hooks are disposed along each edge of the rear wall panel, although other suitable numbers could also be used. Again, the hooks are shown to be vertically-arranged and downwardly-oriented, although other suitable configurations could also be used. Also again, the hooks are integrally formed into the edges of the side wall panels by suitable means such as machining.

The restroom 10 also includes a pair of rear, vertically-disposed, corner portions 68 and 70 made from a twin sheet, double-wall, thermoformed plastic material, such as polyethylene or other suitable material. Each rear corner portion has opposing vertical side edges, each of which includes a plurality of slots 72 (shown only along one edge of the corner portion 68; not visible on the corner portion 70) disposed along its vertical side edges. The slots 72 are shown to be vertically arranged for matching the number and configuration of the hooks provided along the edges of the side wall panels, although other suitable numbers and configurations could also be used, provided they are complementary to the hook number and design. In this way, the slots 72 are able to accept the insertion of the hooks from the side wall panels (52 and 56) and the hooks from the rear wall panel (64 and 66). Upon insertion of the hooks along each side edge of the side and rear wall panels within the slots along each side edge of the rear corner portions, a downward movement of the side wall panels 38 and 40 and rear wall panel 58 relative to the rear corner portions 68 and 70 operates to interlock the side wall panels, rear corner portions and rear wall panel in a removable assembled condition. The assembled condition of these components is therefore accomplished without the use of mechanical fasteners, such as rivets, screws or nuts and bolts. However, mechanical fasteners (of a number much fewer than previously required) can optionally be added for enhancing a secured condition among the assembled components, if desired.

The restroom 10 further includes a pair of front, vertically-disposed, corner portions 74 and 76 that are of different configuration relative to the rear corner portions 68 and 70. The rearward-facing vertical side edges of the front corner portions 74 and 76 each include a plurality of vertical slots 78 (shown only on the corner portion 76; not visible on the corner portion 74). These slots 78 accept the insertion of corresponding hooks 50 and 54 from the frontward vertical edges of the side wall panels 38 and 40. In the same manner as previously described, a downward movement of the side wall panels 38 and 40 relative to the front corner portions 74 and 76 operates to interlock the side wall panels and front corner portions in a removable assembled condition. The assembled condition of these components is therefore again accomplished without the use of mechanical fasteners, such as rivets, screws or nuts and bolts. However, mechanical fasteners (of a number much fewer than previously required) can optionally be added for enhancing a secured condition among the assembled components, if desired.

The edges of the front corner portions extending in opposed relation upon the front of the restroom 10 are not provided with slots of the type previously described. Instead, a door 80 is provided for attachment in the space on the front of the restroom 10 between the two front corners 74 and 76 in an assembled condition. The door 80 is in the nature of a twin-sheet, double wall, thermoformed design, made of a suitable plastic material such as polyethylene. The door 80 has a hinge edge 82, for hingedly attaching the door 80 to one front corner portion (such as the left front corner portion 74) and a locking edge 84, for securing the door 80 in a closed position against the other front corner portion (such as the right front corner portion 76) for maintaining a closed condition of the restroom. It will be appreciated, however, that the direction for mounting and opening the door may be reversed if desired.

The attachment of the door 80 may be accomplished in the following manner. The front-facing vertical side edge of said one front corner panel (such as the left front corner portion 74) includes a plurality of hollow cylindrical hinge extensions 86 operable for engaging a corresponding complementary plurality of hollow cylindrical hinge extensions 88 disposed along the hinge edge 82 of the door 80 in an interlocking manner. In similar manner as a conventional door hinge, the engagement of these extensions permits the insertion of a vertically-disposed hinge tube 90 between the door 80 and the front corner panel 74 for hingedly attaching these components in a removable manner without the use of mechanical fasteners. One or more springs 92 can be connected to the hinge tube 90 to urge the door 80 toward a closed position, thereby maintaining a closed condition of the restroom 10.

A roof 94 is also provided for the restroom 10, which is provided in a double-wall configuration, rotationally molded from a suitable plastic material, such as polyethylene. The roof 94 is removably attached to the top edges of the four corner portions 68, 70, 74 and 76 using four removable clips 96 that are rotationally molded. The clips 96 include projections 98 that are inserted into holes located in the roof (not shown) and into holes 100 located along the top edges of the four corner portions 68, 70, 74 and 76. In this way, the clips 96 are operable for removably securing the roof 94 relative to the corner portions 68, 70, 74 and 76 in an assembled condition without the use of separate mechanical fasteners.

Figure 7:
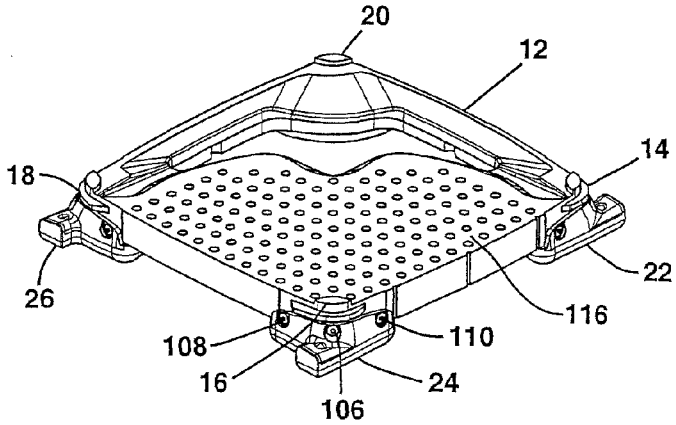
FIG. 7 is a perspective, front and right, view of a base platform for the modular portable restroom.
Figure 8:
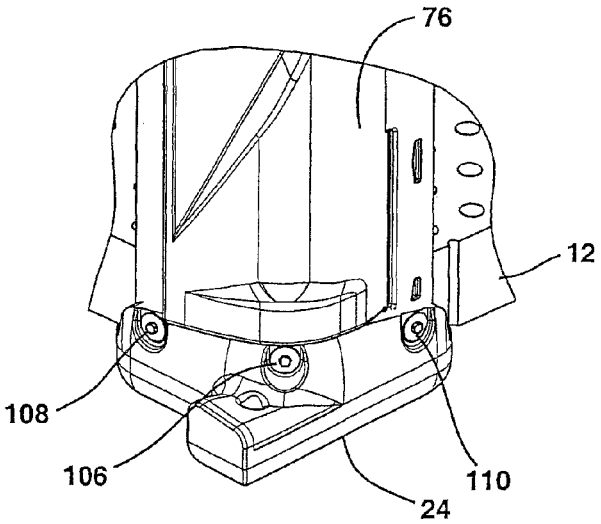
FIG. 8 is a perspective corner view showing the attachment of a foot portion to the restroom base platform.
Figure 9:
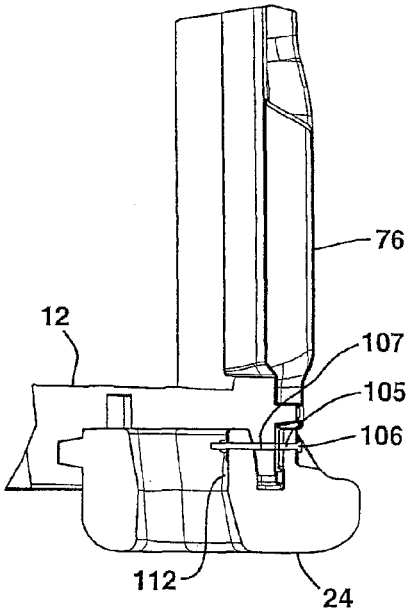
FIG. 9 is a cross-sectional view showing the attachment of a foot portion and a corner portion to the restroom base platform. Corresponding reference numerals indicate corresponding parts throughout the several views of the drawings.

The only use of mechanical fasteners required for maintaining as assembled condition of the restroom 10 is upon the lower portions of the restroom. As previously described, each foot portion 22, 24, 26 and 28 includes a recess 30, 32, 34 and 36 (see FIG. 5) formed therewithin. The purpose of the recesses is to accept the insertion of overlapping edges or sections of the corner portions 68, 70, 74 and 76 and the four corners 14, 16, 18 and 20 of the base platform 12. Together, these components are secured using a minimum of mechanical fasteners to maintain an assembled condition of the restroom as a whole. Accordingly, the lower sections of the corner portions are each provided with a flange 102 having holes 104, through which fasteners can be inserted. Similarly, the foot portions 22, 24, 26 and 28 and the lower sections of the corner portions may also be provided with holes (such as those shown at 105 and 107 in FIG. 9) for the insertion of such fasteners. Specifically, as shown in FIGS. 8 and 9 (and in FIG. 7 without additional components), three such fasteners may be used to secure these components together at each corner of the restroom. A nut and bolt with washer is shown at 106 as the center of the three fasteners, while fasteners 108 and 110 may be lag screws with washers. The nuts are able to be secured to the bolts through lower recesses 112 formed into each foot portion 22, 24, 26 and 28, as shown in exemplary manner in FIG. 9.

The restroom 10 also includes additional features designed to enhance its assembly, operation and maintenance. As shown in FIG. 5, the roof may include an integrated recessed header 114 designed to act as an additional stop for the door 80. The header 114 tends to prevent the door 80 from sagging in the event that the door is damaged or if the restroom is mishandled during transport. The side wall panels 38 and 40 and/or rear wall panel 58 may also be provided with substantially smooth surface configurations for facilitating cleaning. The base platform 12 may also include an upper surface that is tilted (shown at 116 in FIGS. 5 and 7) toward an edge of the base platform (such as the rear edge or a rear corner) to promote draining of fluids away from the restroom door 80.

The restroom 10 may also include a waste storage tank 118 having a lower surface (not shown) that is tilted in a manner complementary to the upper surface 116 of the base platform 12 for enhancing a retained condition of the waste storage tank 118 at a location adjacent to a rear edge of the base platform 12 (again, such as the rear edge or a rear corner). The waste storage tank 118 may also include one or more locking flanges or tabs 120 for engaging diagonally-opposed corner portions of the restroom for helping to retain the waste storage tank 118 in its desired location adjacent to a rear edge of the base platform 12. In the event that the restroom 10 is tipped over, these features help to retain the waste storage tank 118 in place and minimize spillage of waste contents.

In addition, one or more of the side or rear wall panels (or the door) may optionally include space suitable for containing advertising material. For example, a thin, clear polycarbonate matching overlay panel may be applied upon the exterior (or interior) surface of any wall panel (or door), with advertising material inserted therebetween. Also, a custom, rectangular, removable plate 122 may be located in the lower section of the door 80 for the inclusion of custom owner identification, such as logos. Each foot portion 22, 24, 26 and 28 may also include molded apertures 124, 126, 128 and 130 (FIG. 5) for securing the restroom in place upon the ground using stakes or other implements.

Figure 2:
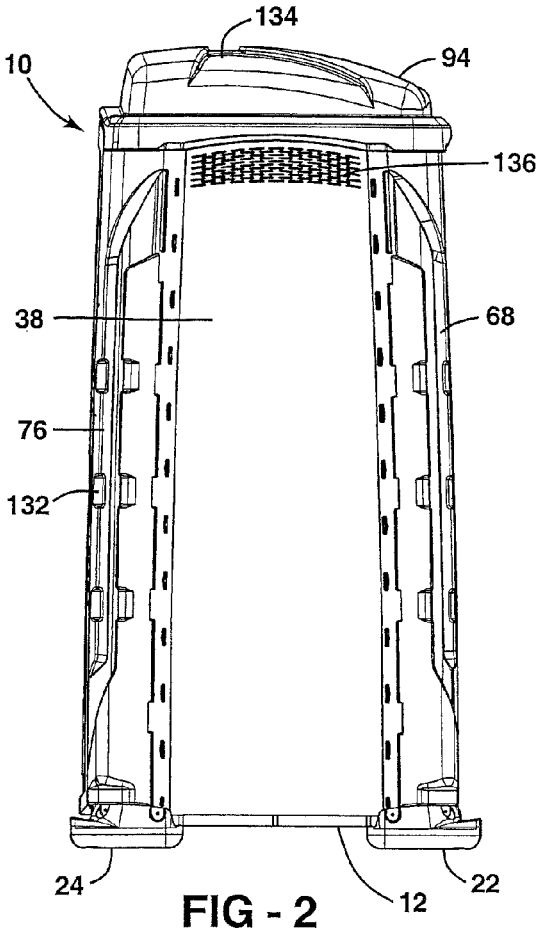
FIG. 2 is a side, elevational view thereof.
Figure 3:
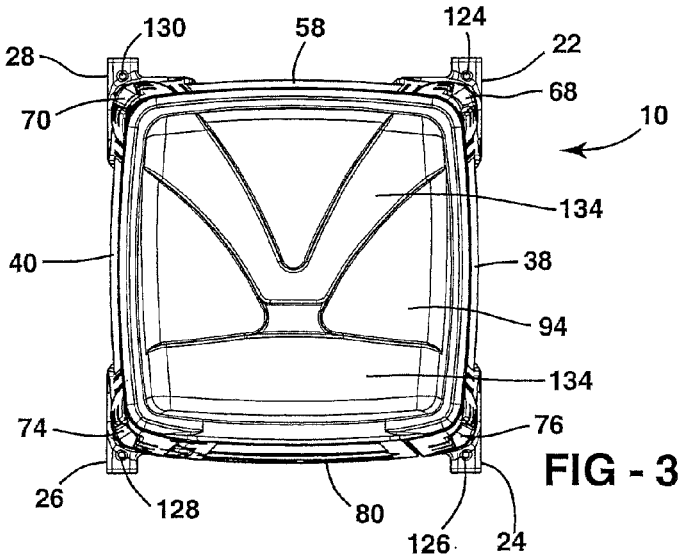
FIG. 3 is a top view thereof.
Figure 4:
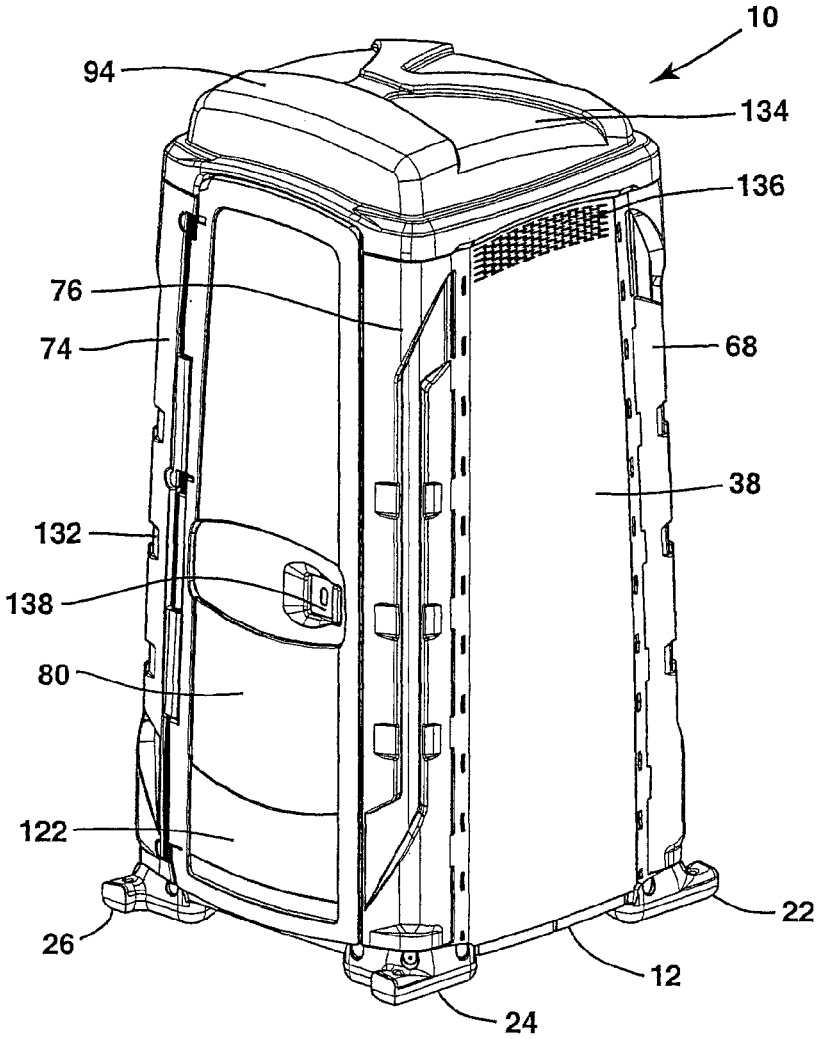
FIG. 4 is a perspective, front and right, view thereof.

For assisting the transport of the restroom units, the foot portions 22, 24, 26 and 28 may extend outwardly from each corner of the base portion 12 by a convenient amount (such as 2½ inches or 63 mm) for facilitating the attachment of straps around the restroom. Such outward extensions also allow for easy identification of entry way for moving equipment. The corner portions 68, 70, 74 and 76 may also each include strapping grooves (such as that shown at 132 in FIGS. 1 and 2) molded into multiple locations upon the corner portions for facilitating transportation of the restroom, while accommodating varying heights for different types of pumper trucks and trailers. The roof 94 may also include recesses (such as those shown at 134 in FIGS. 2 and 3) molded into the roof for facilitating the attachment of straps around the restroom for transporting the restroom.

The restroom 10 is otherwise designed to include additional relevant convenience features, such as a toilet, urinal and/or hand-washing sink, and ventilation for the waste storage tank 118. To enhance ventilation within the restroom itself, vents 136 may be machined directly into the wall panels (which may optionally covered by attached screens). The door 80 may also be latched in conventional manner through the use of latch/handle mechanism 138.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A modular portable cabana-type restroom comprising:

A base platform of a generally square flat configuration, having four corners;

a plurality of foot portions removably attached to each of said corners, each foot portion having a recess disposed therewithin;

a pair of side wall panels, each side wall panel having first and second vertical side edges and each including a plurality of hooks disposed along said first and second vertical side edges;

a back wall panel having first and second vertical side edges and including a plurality of hooks disposed along said first and second vertical side edges;

a pair of rear, vertically-disposed, corner portions having first and second vertical side edges and each including a plurality of slots disposed along said first and second vertical side edges, said rear corner portions each operable for attachment to said pair of side wall panels and said back wall panel without the use of separate mechanical fasteners between said corner portions and said pair of side wall panels and said back wall panel and without sliding or otherwise contacting said side wall panels and said rear corner portions relative to each other over their entire vertical lengths, through the engagement of said hooks along each wall panel edge with said slots within the interior of each corner portion vertical side edge;

a pair of front, vertically-disposed, corner portions having first and second vertical side edges and each including a plurality of slots disposed along said first vertical side edge, said front corner portions each operable for attachment to said pair of side wall panels without the use of separate mechanical fasteners between said corner portions and said pair of side wall panels and without sliding or otherwise contacting said side wall panels and said front corner portions relative to each other over their entire vertical lengths, through the engagement of said hooks along each wall panel edge with said slots within the interior of each corner portion first vertical side edge;

a door having a hinge edge and a locking edge, said door hingedly attached along its hinge edge to the second vertical side edge of one front corner panel and operable for being opened for accessing an interior portion of the restroom and closed at its locking edge against the second vertical side edge of the other front corner panel for maintaining a closed condition of the restroom; and a roof capable of being removably secured relative to said corner portions in an assembled condition;

wherein said corner portions and said base platform are each operable to be inserted within said recesses of said foot portions; and wherein a plurality of removable mechanical fasteners are disposed through said foot portions, said base platform and said corner portions for securing said foot portions, said base platform, said corner portions and said wall panels together for maintaining an assembled condition of said restroom.

2. The modular portable cabana-type restroom as defined in claim 1, wherein said roof contains a recessed header for engaging an upper surface of said door in a closed condition.

3. The modular portable cabana-type restroom as defined in claim 1, wherein said second vertical side edge of said one front corner panel includes a plurality of hollow cylindrical hinge extensions operable for engaging a corresponding complementary plurality of hollow cylindrical hinge extensions disposed along said hinge edge of said door in an interlocking manner, said engagement being operable to permit the insertion of a vertically-disposed hinge tube between said door and said front corner panel for hingedly attaching said door to said front corner panel.

4. The modular portable cabana-type restroom as defined in claim 1, wherein at least one of said wall panels is substantially smooth in its surface configuration for facilitating cleaning.

5. The modular portable cabana-type restroom as defined in claim 1, wherein said base platform includes an upper surface that is tilted toward an edge of the base platform to promote draining of fluids away from the restroom door.

6. The modular portable cabana-type restroom as defined in claim 5, further comprising a waste storage tank having a lower surface that is tilted in an orientation departing from a horizontal orientation in a manner complementary to said upper surface of said base platform for enhancing a retained condition of said waste storage tank at a location adjacent to a rear edge of said base platform without the use of mechanical fasteners.

7. The modular portable cabana-type restroom as defined in claim 1, further comprising a waste storage tank that includes a plurality of integrated locking tabs operable for engaging diagonally-opposed corner portions of the restroom for enhancing a retained condition of said waste storage tank at a location adjacent to a rear edge of said base platform without the use of separate mechanical fasteners.

8. The modular portable cabana-type restroom as defined in claim 1, wherein at least one of said wall panels includes space suitable for containing advertising material.

9. The modular portable cabana-type restroom as defined in claim 1, wherein said plurality of foot portions extend outwardly from each said corner of said base portion for facilitating the attachment of straps around the restroom for transporting the restroom.

10. The modular portable cabana-type restroom as defined in claim 1, wherein said corner portions each include grooves molded into the corner portions for facilitating transportation of the restroom.

11. The modular portable cabana-type restroom as defined in claim 1, wherein said roof includes recesses molded into the roof for facilitating the attachment of straps around the restroom for transporting the restroom.

12. The modular portable cabana-type restroom as defined in claim 1, wherein a plurality of removable clips are attached between said roof and said corner portions, said clips operable for removably securing said roof relative to said corner portions in an assembled condition.

* * * * *